United States Patent [19]

Sunagawa et al.

[11] Patent Number: 5,003,663

[45] Date of Patent: Apr. 2, 1991

[54] UPRIGHT-TYPE ELECTRIC VACUUM CLEANER

[75] Inventors: Masao Sunagawa; Kazuhiro Kubota; Yoshitaro Ishii, all of Hitachi; Susumu Satoh, Takahagi, all of Japan

[73] Assignee: Hitachi, Ltd., Tokyo, Japan

[21] Appl. No.: 287,157

[22] Filed: Dec. 21, 1988

Related U.S. Application Data

[62] Division of Ser. No. 908,670, Sep. 17, 1986.

[51] Int. Cl.[5] ..... A47L 5/30

[52] U.S. Cl. ..... 15/366; 15/182; 15/392; 15/383

[58] Field of Search ..... 15/5, 42, 41 R, 179, 15/182, 366, 392, 323

[56] References Cited

U.S. PATENT DOCUMENTS

| | | | |
|---|---|---|---|
| 2,633,596 | 4/1953 | Turner et al. | 15/323 |
| 4,209,873 | 7/1980 | Schaefer | 15/366 X |
| 4,221,019 | 9/1980 | Jäger et al. | 15/41 R X |

FOREIGN PATENT DOCUMENTS

| | | | |
|---|---|---|---|
| 364362 | 1/1932 | United Kingdom | 15/366 |
| 1374420 | 11/1974 | United Kingdom | 15/42 |

*Primary Examiner*—Chris K. Moore

*Attorney, Agent, or Firm*—Antonelli, Terry, Stout & Kraus

[57] ABSTRACT

Disclosed is an upright-type electric vacuum cleaner which comprises a suction port body provided with a rotary brush and a main body case supported tiltably on the suction port body. Improvements are made in details such as the arrangement for supporting the main body case in the suction port body, the arrangements of mounting a handle onto the main body case, the configuration of a main body duct, the arrangement of a rotary brush, the arrangement of a cover of the main body case, and the arrangement of a T-shaped joint for connecting the main body duct and a dust filter means, thereby increasing the strength and rigidity of each of these parts and improving the performance of the vacuum cleaner.

2 Claims, 18 Drawing Sheets

FIG. 13
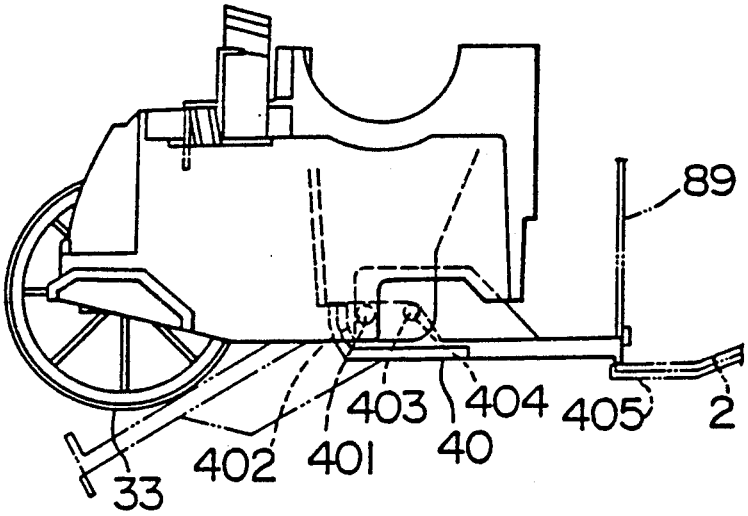
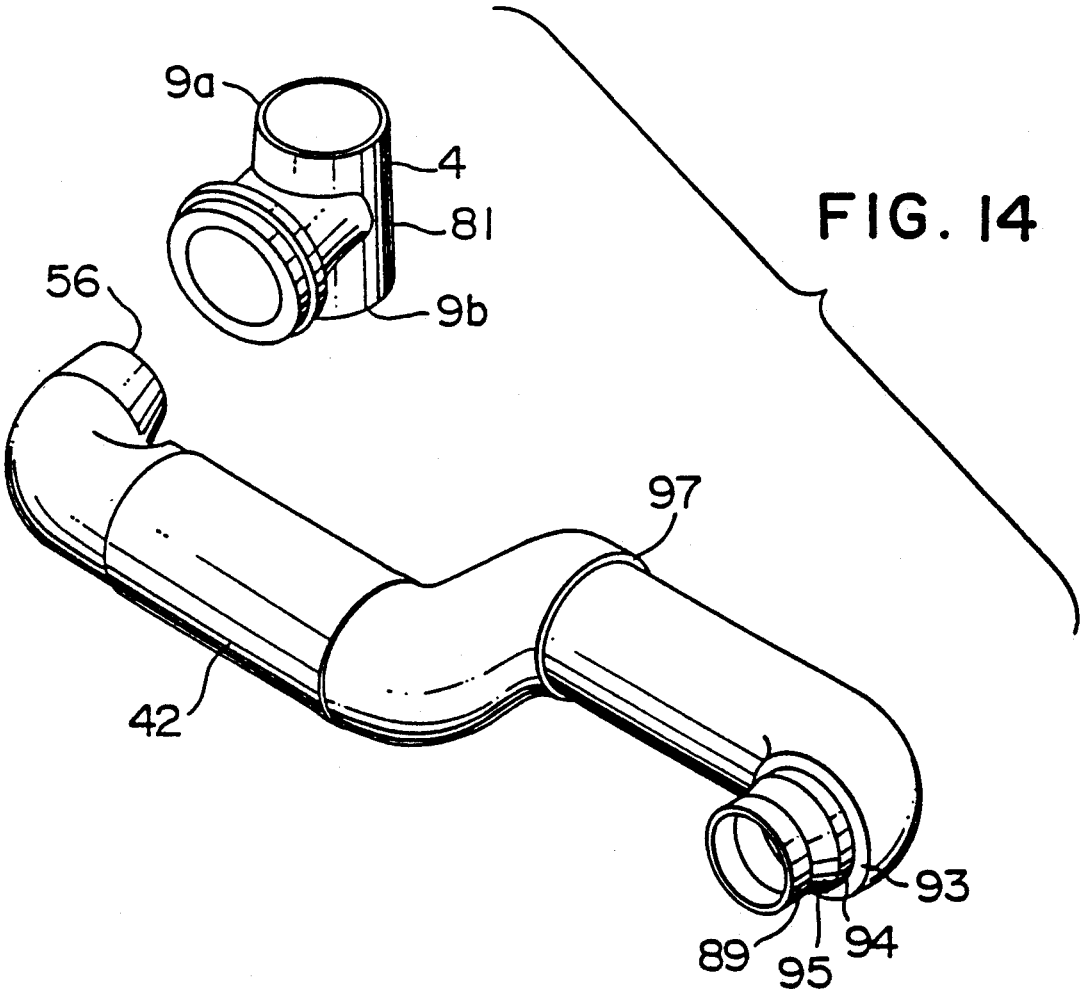
FIG. 14

UPRIGHT-TYPE ELECTRIC VACUUM CLEANER

This is a divisional of application Ser. No. 908,670, filed Sept. 17, 1986.

BACKGROUND OF THE INVENTION

1. Field of the Invention

The present invention relates to an upright type of electric vacuum cleaner, and more particularly to the construction of an upright type of electric vacuum cleaner in which a large volume of plastic members is employed, the number of component parts employed is reduced, and which is sturdy and has excellent functions.

2. Prior Art

Conventionally, a large volume of plastic material is used in an upright-type electric vacuum cleaner which comprises a suction port body provided with a rotary brush and a main body case supported tiltably on the suction port body. Although plastic components have the advantage that components with complicated shapes can be produced at low cost, plastic components are inferior to metal components in terms of strength. Therefore, with respect to portions such as component-connecting parts, in which stress is liable to concentrate, it is imperative to pay careful attention to their structural design so as to compensate for this drawback.

SUMMARY OF THE INVENTION

Accordingly, an object of the present invention is to provide an upright-type electric vacuum cleaner whose various portions are arranged so as to improve its performance as a cleaner, by making optimum use of the advantages of plastic materials, reduce cost, and compensate for the lack of strength, which is one drawback of plastic materials.

According to the present invention, novel arrangements are provided in details such as the arrangement for supporting the main body case on a suction port body, the form of a rotary brush, the shape of a suction duct, the arrangement of a main body case cover, the arrangement of a connecting portion between the suction duct and a dust filter, and the arrangement by which a handle is mounted onto the main body case.

BRIEF DESCRIPTION OF THE DRAWINGS

FIG. 13 is an explanatory view of a belt cover;

FIG. 14 is a perspective view of a main body duct and a T-shaped joint;

DETAILED DESCRIPTION OF PREFERRED EMBODIMENT

A preferred embodiment of the present invention will be described hereinafter with reference to the accompanying drawings.

Figure 1:
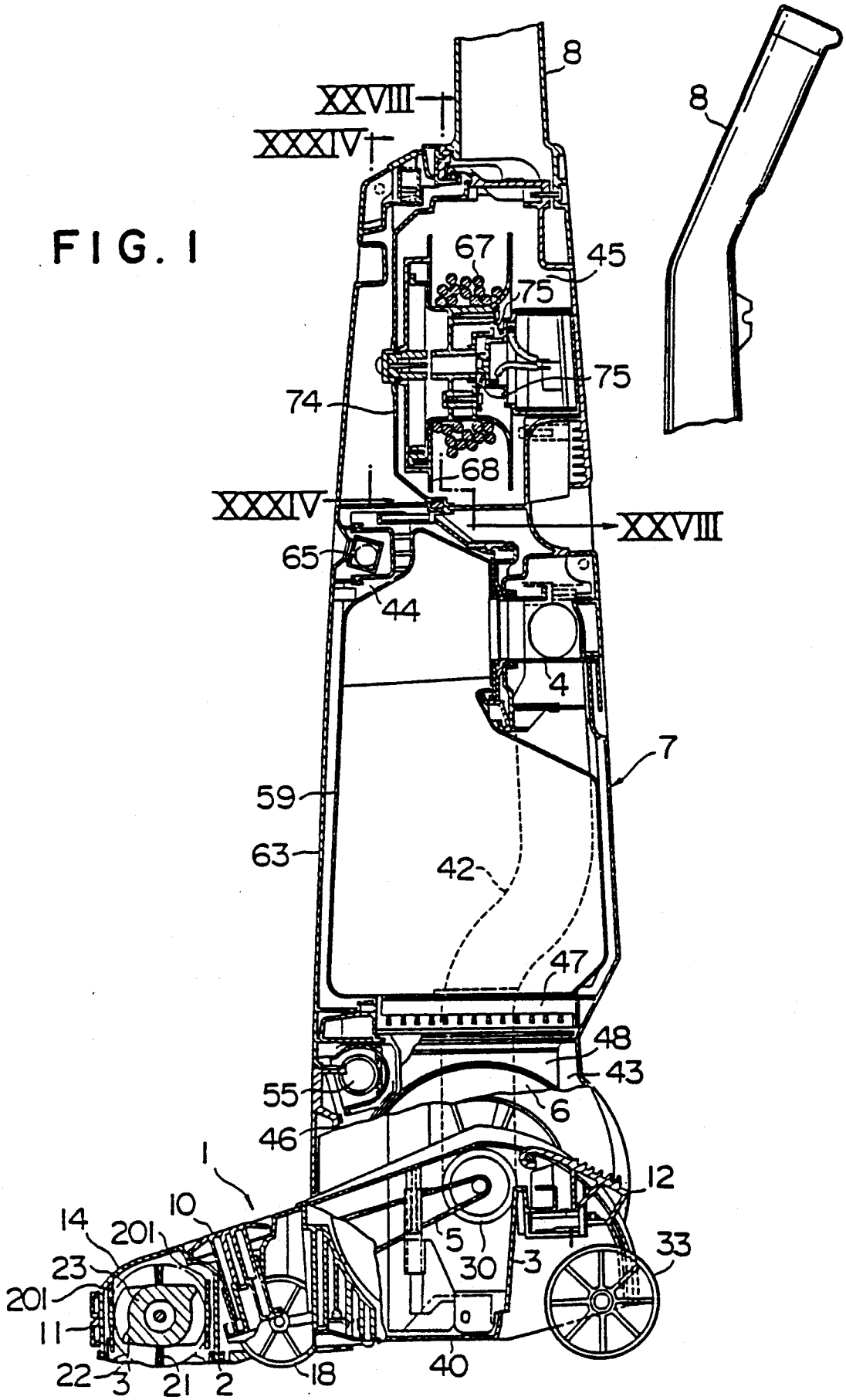
FIG. 1 is a cross-sectional view of an upright-type electric vacuum cleaner illustrating one embodiment of the present invention.

In FIG. 1, a vacuum cleaner has a suction port body 1 and a main body case 7 tiltably mounted on the suction port body 1. The suction port body 1 has a rotary brush 23 disposed above an opening 3 in the suction port body 1, and the rotary brush 23 is rotationally driven by means of an electrically-operated blower 6 via a belt 5.

The main body case 7 has an electrically-operated blower chamber 43 which houses the electrically-operated blower 6, a bag compartment 44 which accommodates a dust filter 59, and a cord reel chamber 45 which houses a card reel 67, etc., and is provided with a control handle 8 on the outside thereof.

Figure 3:
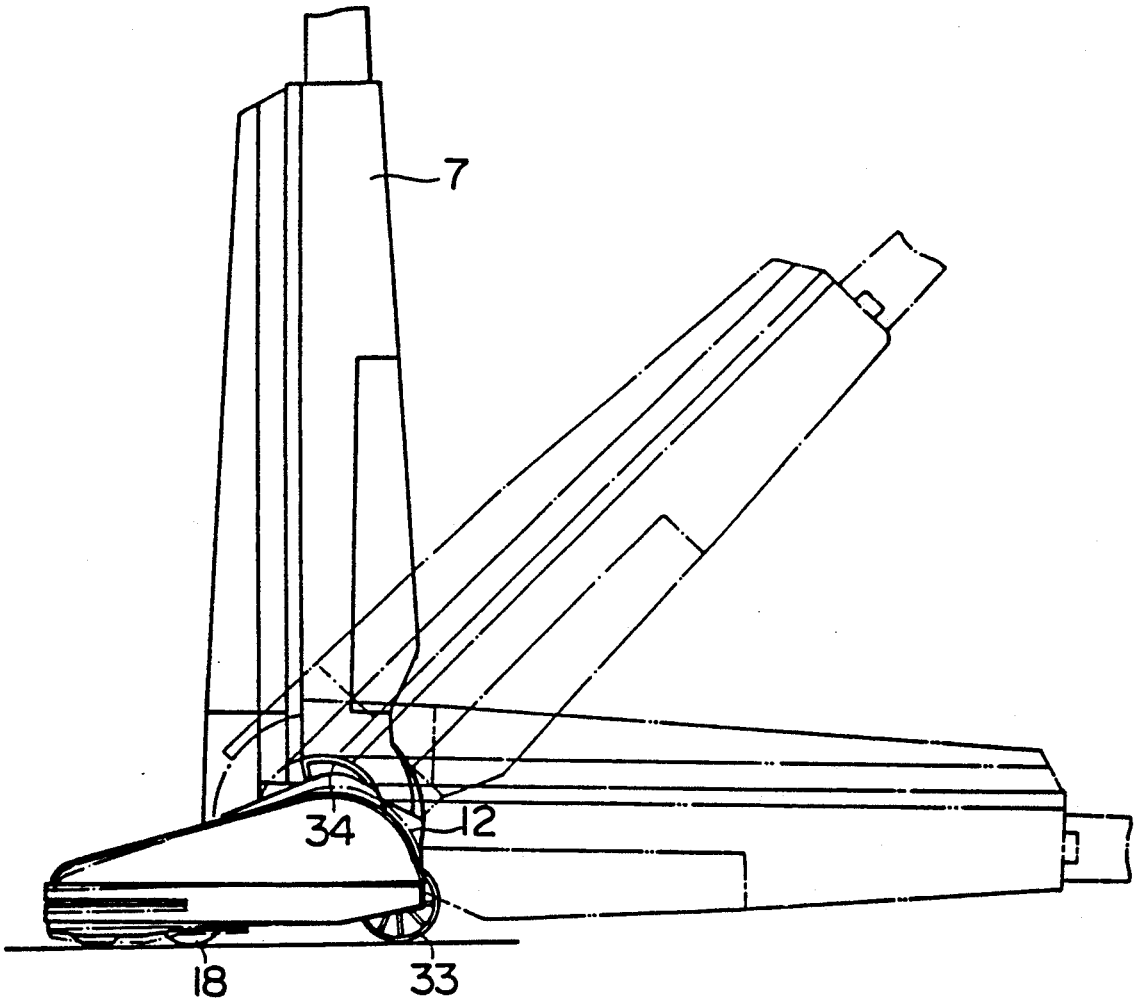
FIG. 3 is a diagram illustrating the tilting of a main body in accordance with the present embodiment.

The main body case 7 is mounted tiltably, as shown by solid lines and dash-dot lines in FIG. 3, and is so arranged that, when it is inoperative, it can stand in an upright position on the suction port body 1 (shown by solid lines). When the main body case 7 is in the upright position, front wheels 18 are adapted to correspondingly move downwardly so as to move the front portion of the suction port body 1 slightly upwardly.

The dust collected by the rotary brush 23 passes through a suction duct 41 (not shown in FIG. 1) inside the suction port body 1 and a main body duct 42 inside the main body case, and is sucked into the dust filter 59. The suction port duct and the main body duct are connected to each other in a rotary shaft portion 30 of the main body case so as to be mutually rotatable.

The outside of the suction port body 1 is provided with a changeover knob 10 for adjusting the distance between a bottom plate and a floor surface, a bumper 11 for preventing damage to furniture, a pedal 12 used in cases such as when the main body case 7 is to be engaged on the suction port body 1, a base frame 13 which pivotally supports the main body case 7, a front frame 14, and so forth.

Figure 4:
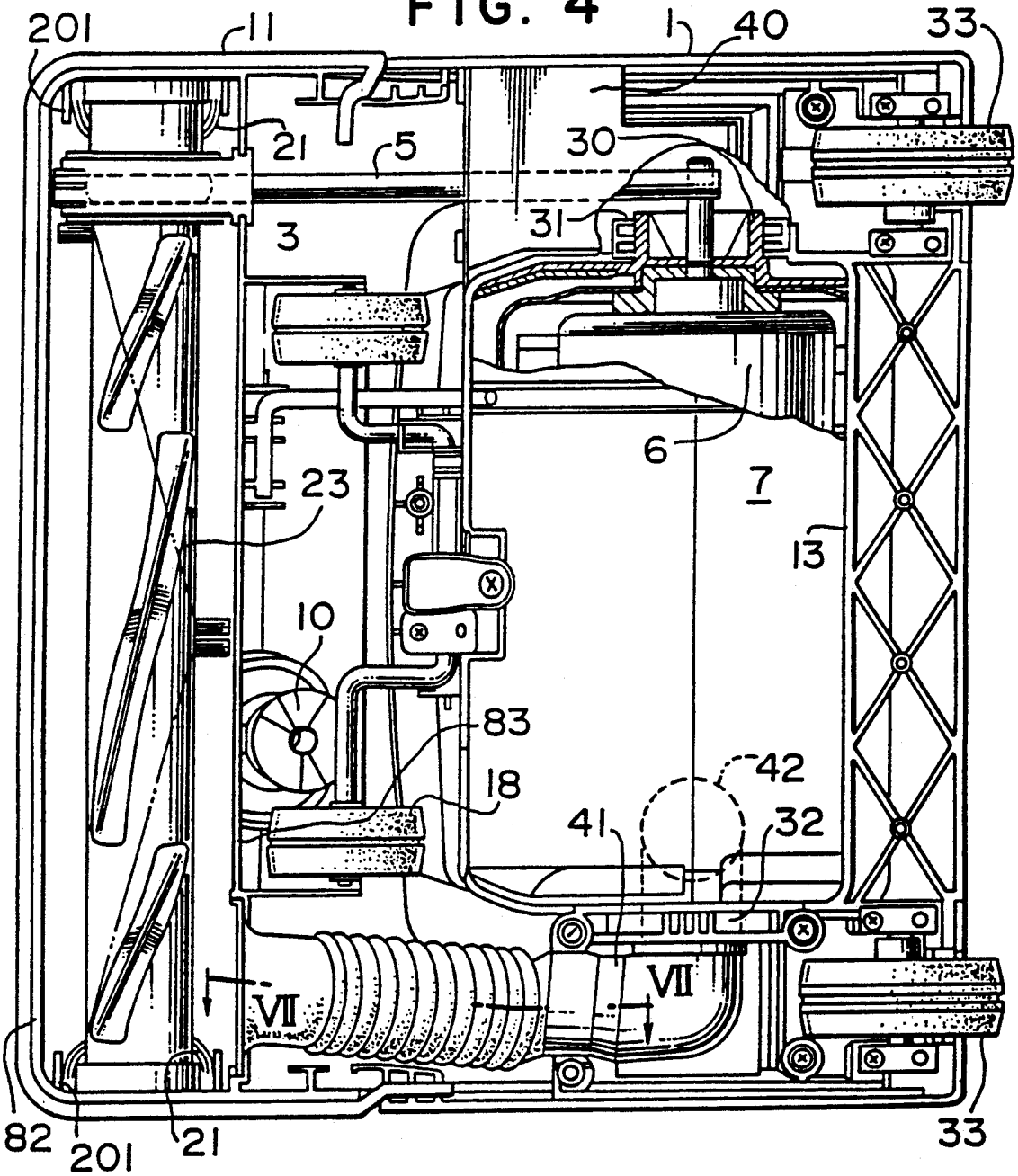
FIG. 4 is a plan view as seen from below the vacuum cleaner.
Figure 5:
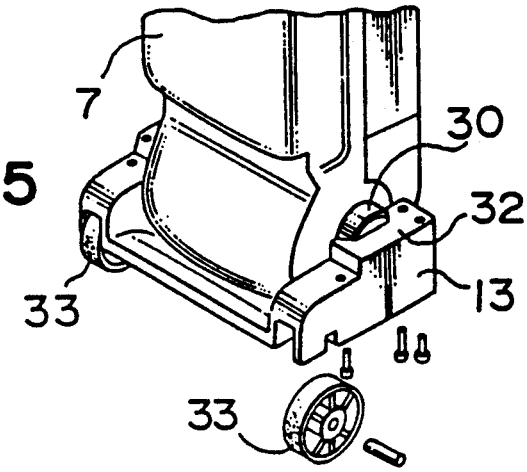
FIG. 5 is a perspective view of a base frame.
Figure 6:
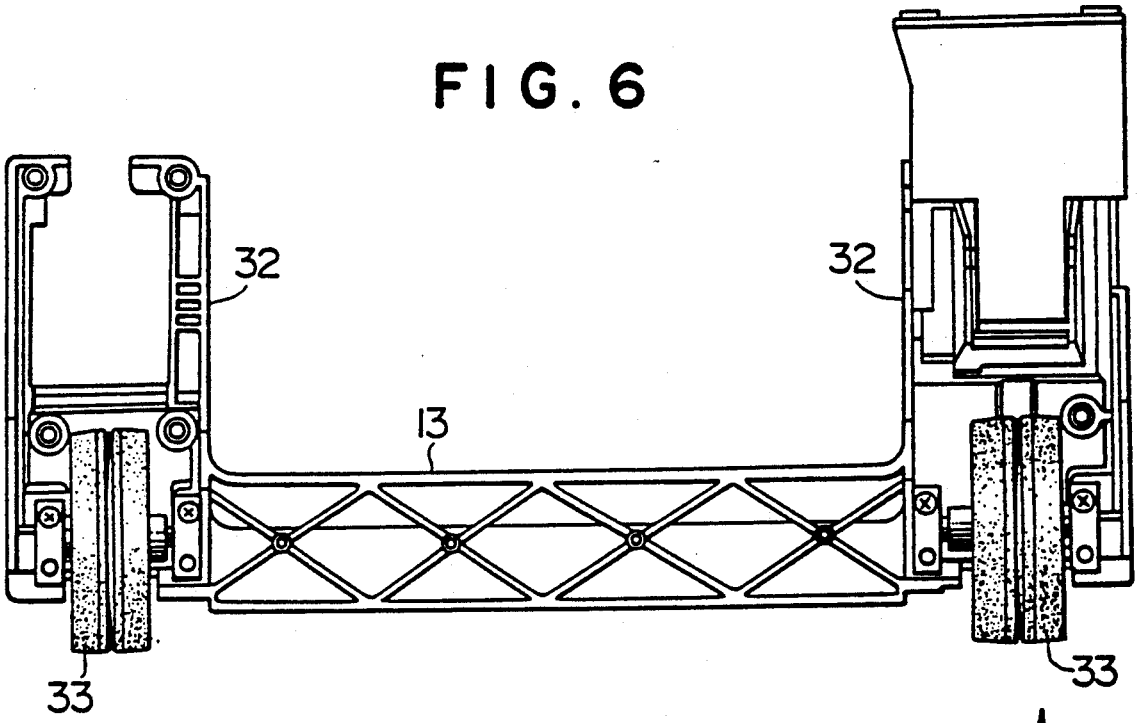
FIG. 6 is a plan view of the base frame.

As shown in FIGS. 4 and 5, the base frame 13 is disposed at the rear end portion of the suction port body 1 and pivotally supports a rotary shaft 30, which is provided integrally with the main body case 7, in cooperation with a downwardly opened semi-arc-shaped bearing rib 31 of a front frame 14 of the suction port body 1. The base frame 13 has a upwardly opened semi-arc-shaped bearing portion 32, is shaped substantially like a letter U when viewed from the bottom surface thereof, as shown in FIG. 6, and is provided with rear wheels 33 in the vicinity of the bearing portion 32.

Figure 7:
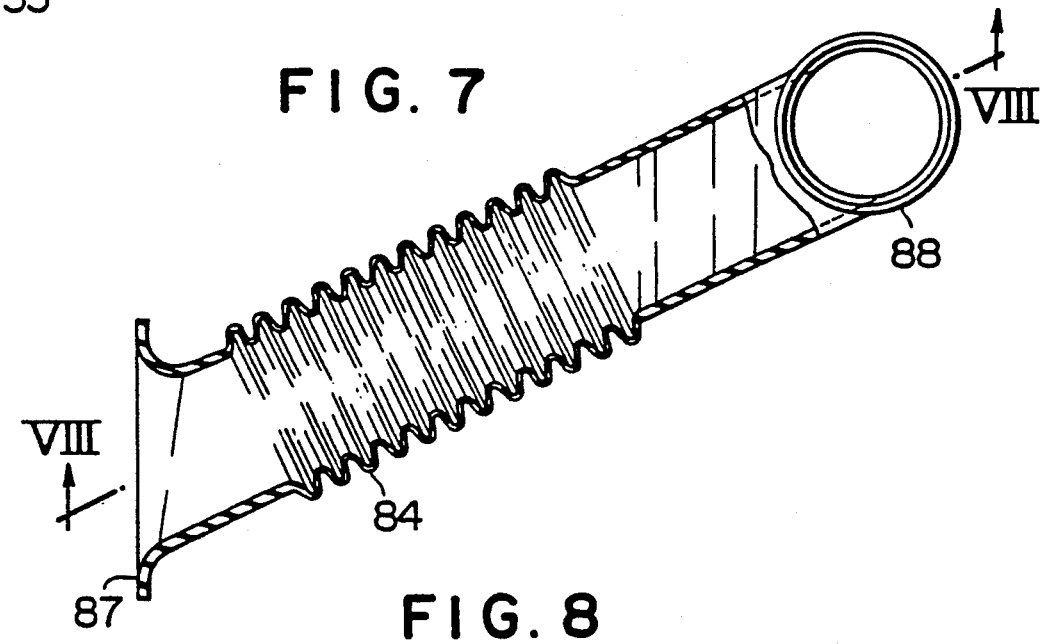
FIGS. 7 and 8 are cross-sectional views of a suction duct.
Figure 8:
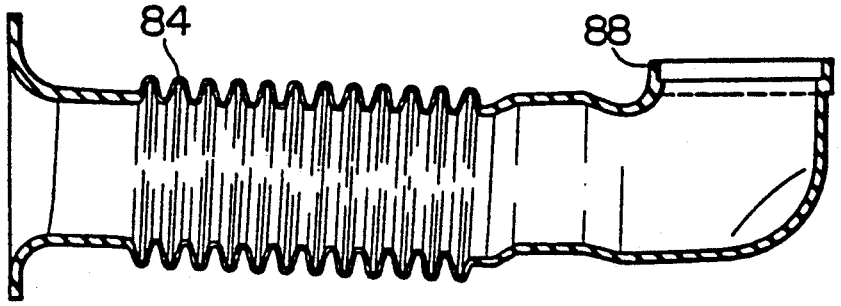

The suction port duct 41 shown in FIG. 4 has a corrugated portion 84 designed to impart elasticity to an intermediate portion thereof, as shown in FIGS. 7 and 8, and the opening 3 side of the suction port body 1 has a flange portion 87 fitting into a groove formed in a rib 83 disposed on the suction port body 1. The portion of the suction port body 1 fitting into the main body duct 42 is formed in the shape of an elbow so that the channel thereof is bent substantially through 90°, and the end surface thereof has a cylindrically-shaped fitting portion 88 formed in a stepped shape in such a way that it receives the main body duct 42 in a rotatable manner. The suction duct is secured to the base frame 13 in the vicinity of the fitting portion 88.

Figure 9:
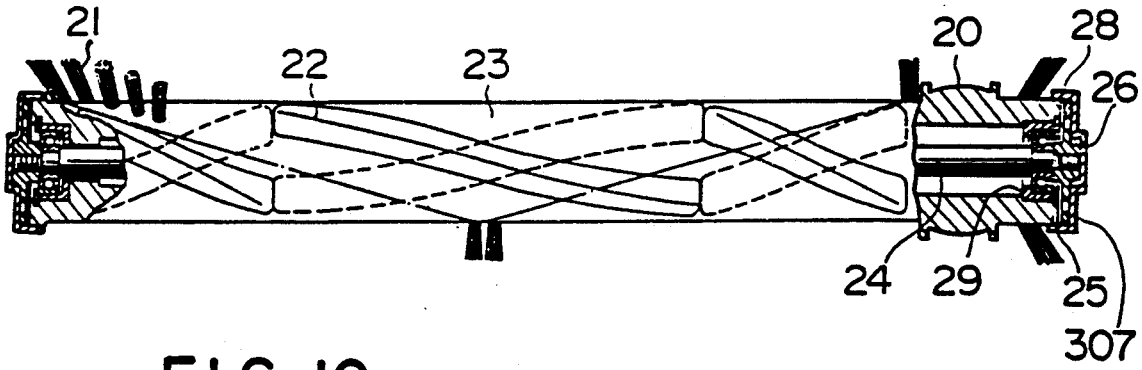
FIG. 9 is a partial vertical cross-sectional view of a rotary brush.
Figure 10:
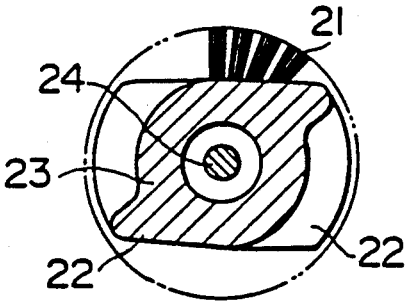
FIG. 10 is a transverse cross-sectional view of the rotary brush.

As shown in FIGS. 1 and 4, the rotary brush 23 is disposed at the front end portion of the suction port 1. As shown in FIG. 9, a drive pulley 20 for rotating the rotary brush 23 is provided at one end of the rotary brush 23. Bristles 21 and projections 22 are provided spirally on the outer periphery of the rotary brush 23. In the present invention, however, the spiral projections 22 provided on the outer periphery of the rotary brush 23 are disposed symmetrically about the center axis of the rotary brush 23. In addition, the spiral projections 22 on the rotary brush 23 are divided in the axial direction of the rotary brush 23. Moreover, as shown in FIG. 10, the spiral projections 22 on the rotary brush 23 are shaped in such a manner that no undercut is created so that the entire brush can be molded by a pair of metal molds mating in a plane which includes the axis of the rotary brush 23. At least one row of the spiral bristles 21 are embedded in a line between the projections. In the embodiment shown in FIG. 9, three spiral projections 22 of the rotary brush 23 are provided on the front of the rotary brush 23, and three on the rear thereof. Incidentally, the thickness of the rotary brush 23 must be made relatively large enough to enable the embedding of the bristles, and the rotary brush 23 is therefore made bY injection-molding a plastic with a foaming agent mixed therein. In addition, as shown in FIG. 9, the inside of the rotary brush 23 is made hollow to receive a fixing shaft 24 which is pivotally supported by bearings 25. A bearing cover 26 is disposed at each end of the fixing shaft 24 and the rotary brush 23 is detachably mounted on the suction port body 1 via vibration-proof caps 307 made of an elastic material. The vibration-proof caps 307 are designed to keep the suction port body 1 insulated from vibration of the rotary brush 23, and also have the function of preventing dust from entering the bearing 25. Furthermore, to adjust for play in the axial direction of the rotary brush 23, a thrust spring 29 is provided between each bearing 25 and the corresponding surface of the rotary brush 23 in contact with the bearing.

In the present invention, as shown in FIG. 9, the bristles 21 are embedded into both end regions of the rotary brush 23 diagonally to the axis of the rotary brush in directions axially outwardly and radially outwardly of the brush. Moreover, as shown in FIGS. 1 and 4, ribs 201 which extend vertically while sandwiching rotary brush 23 are provided on the inner surface of the side walls of the suction port body 1. Thus, when the rotary brush 23 rotates, the diagonally-embedded bristles come into contact with the opposing surfaces of the ribs 201, and are thereby bent so that the bristles move closer to the axis of the rotary brush 23. This bending of the bristles at the end portions of the rotary brush 23 is convenient for cleaning the corners where the floor and the wall meet each other.

Figure 11:
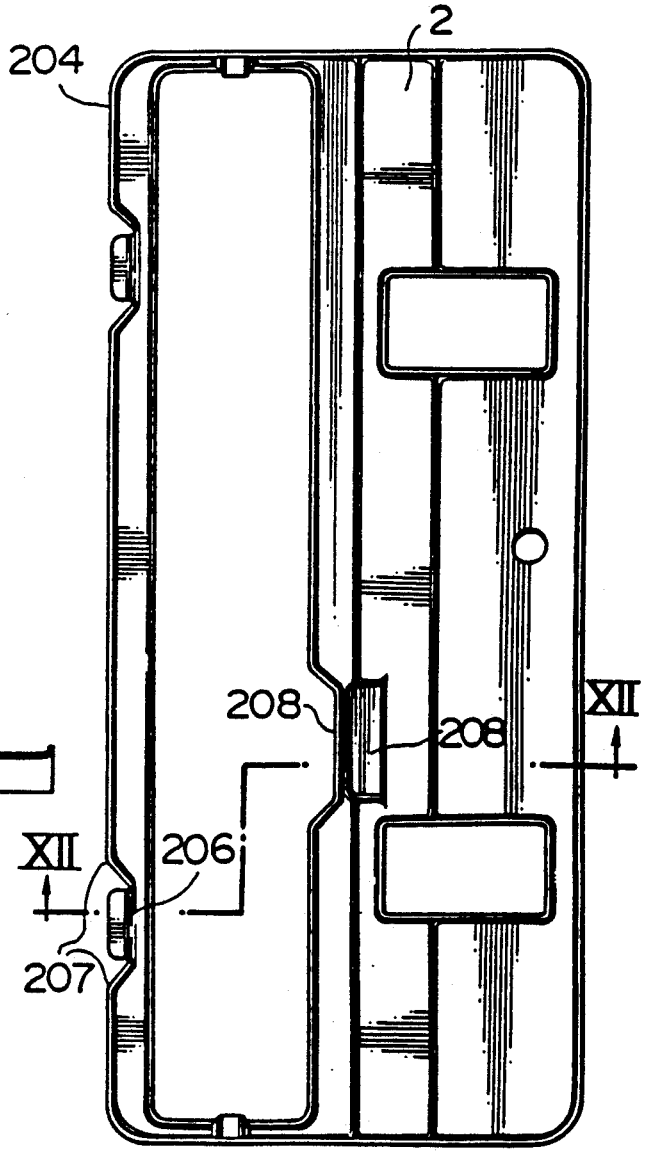
FIG. 11 is a plan view of the bottom plate of a suction port portion.
Figure 12:
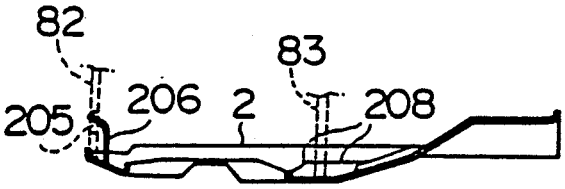
FIG. 12 is a cross-sectional view taken along the line XII—XII of FIG. 11.

A metal bottom plate 2 which defines a suitable opening for the rotary brush 23 is provided detachably on the suction port body 1 below the rotary brush 23. As shown in FIGS. 1, 11, and 12, the bottom plate 2 is arranged as follows. The bottom plate 2 has a flange portion 204 which fits around the outer periphery of the suction port body 1, which has the suction opening 3 formed by a peripheral side surface 82 of the suction port body 1 and by the rib 83 located inside the suction port body 1. A groove 205 is provided in the front portion of the outer periphery of the suction port body 1. An inner flange 206, which passes through the groove 205, touches the inner peripheral surface of the suction port body 1, and thereby fits the suction port body 1, is provided in the bottom plate 2.

Furthermore, the bottom plate 2 has side walls 208, which each touch a side surface of the rib 83 inside the suction port body 1.

To install the bottom plate 2, the inner flange 206 is first engaged with the groove 205 provided at the front side of the suction port 1. Then the entire bottom plate 2 in this engaged state is rotated and secured, so that the rib 83 is clamped neatly by the side walls 208.

In accordance with the present embodiment, the installation of the bottom plate 2 is easy. In addition, since the rib 83 inside the suction port body 1 and the peripheral side surface 82 of the suction port 1, which together define the suction opening 3, are clamped, the bottom plate 2 can be positioned stably, and an increased rigidity of the suction opening 3 can be obtained.

A belt cover 40 is provided below the belt 5 inside the base frame 13. As shown in FIG. 13, the belt cover 40 has a rotary shaft 401 which is inserted into a shaft hole 402 in the base frame 13. In addition, a projection 403 for positioning is provided and is adapted to be aligned with a positioning hole 404 in the base frame 13. A knob 405 is provided on an end portion of the belt cover 40 and is arranged so as to be engaged with the bottom plate 2 and with a rib 89 in the suction port body 1.

In FIG. 1, the electrically-operated blower 6, the suction duct 48 communicating with the bag compartment 44, and the inlet of the exhaust duct communicating with the cord reel chamber 45 are provided in the electrically-operated blower chamber 43. The suction duct 48 is secured to an airtight seal rib 96 (see FIG. 15) provided in the main body case 7, via a piece of pliable duct packing which has a circular cross section.

Figure 15:
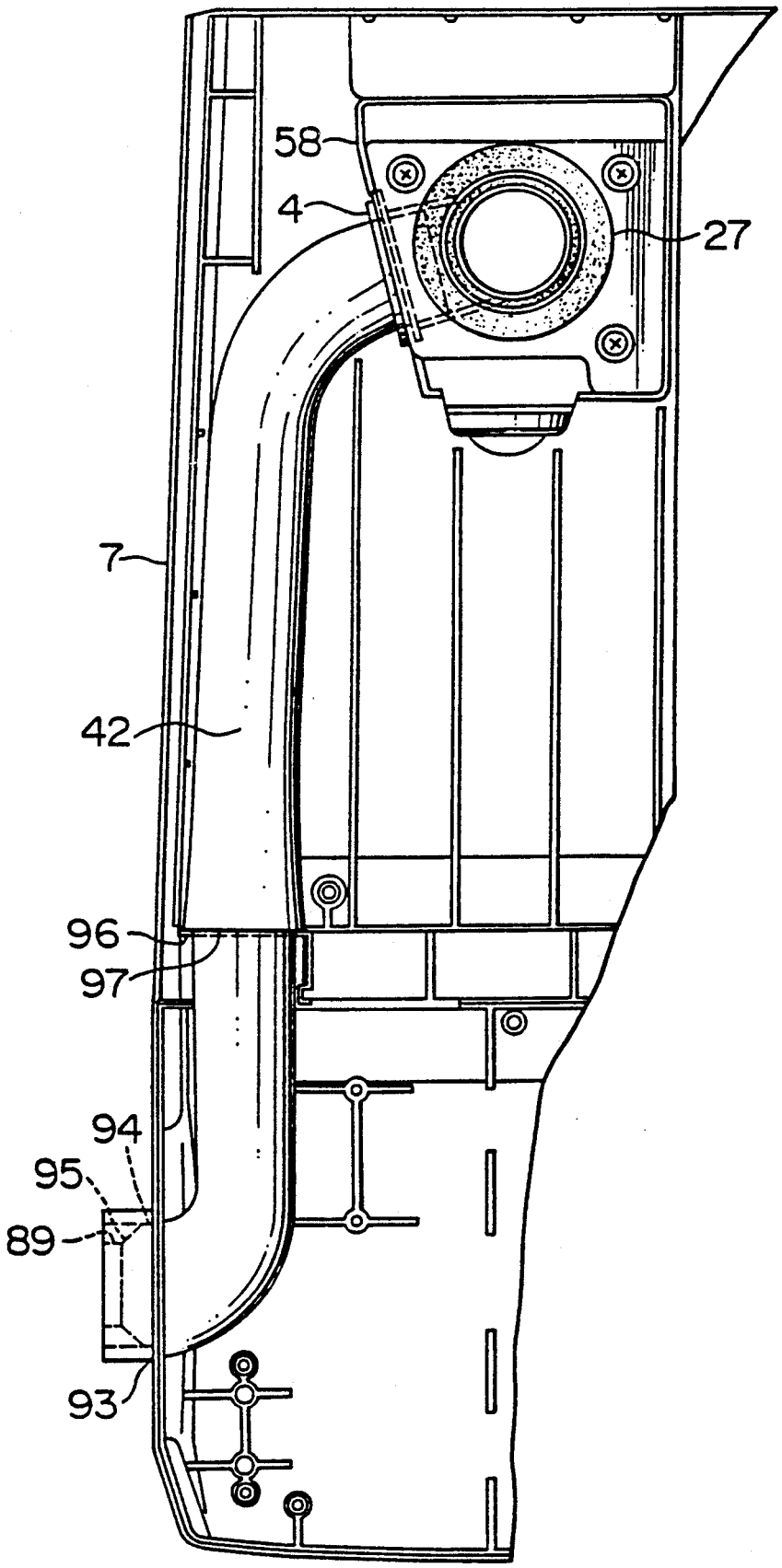
FIG. 15 is a diagram illustrating how the main body duct is mounted onto a main body case.
Figure 16:
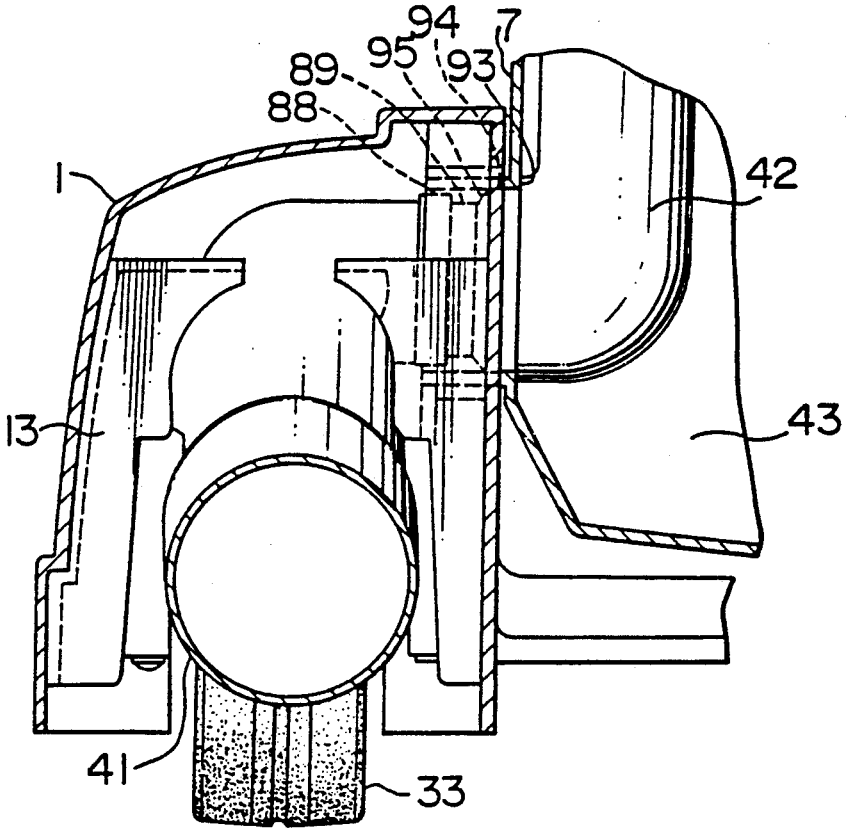
FIG. 16 is a diagram illustrating a state in which the main body duct and the suction port duct are connected together.

As shown in FIGS. 14, 15 and 16, a fitting portion 89 of the main body duct 42 fits rotatably to the fitting portion 88 of the suction port duct 41 at the inside of the rotary shaft 30 of the main body case 7. To prevent the exhaust flow from the electrically-operated blower chamber 43 from passing through the inside of this rotary shaft 30 and into the suction port body 1, the main body duct 42 has a flow-preventing stepped portion 93 which abuts against the inner surface of the side wall of the main body case 7, as well as a positioning portion (main body duct}94 of a diameter which fits the inside diameter of the rotary shaft 30. The fitting portion 89 and the positioning portion 94 are connected to each other by means of a tapered duct portion 95. Since the main body duct 42 extends between the electrically-operated blower chamber 43 and the bag compartment 44, the main body duct 42 has a stepped portion 97 which abuts against the seal rib 96 provided in the main body case 7, to provide an airtight seal between the two chambers (two spaces).

Figure 17:
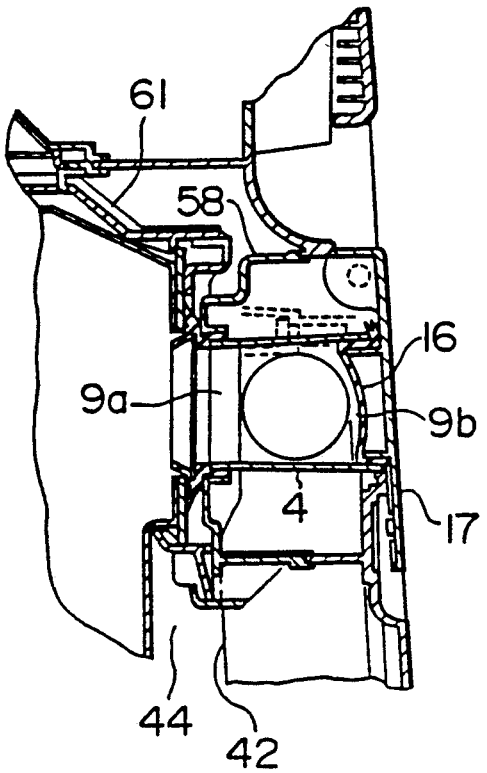
FIGS. 17 and 18 are diagrams illustrating a T-shaped joint.
Figure 18:
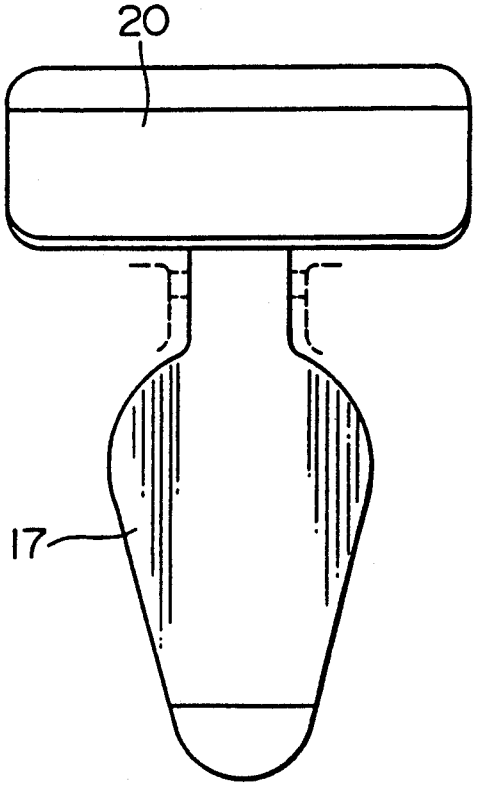

As shown in FIGS. 1, 14 and 17, a T-shaped joint 4 is provided in the bag compartment 44 and is connected to one opening end 56 of the main body duct 42. This T-shaped joint 4 is bifurcated, with one opening end portion 9*a* thereof mounted onto the main body case 7 by means of a box-like filter base 58, via a piece of a airtight packing 27, while the other opening 9*b* is normally blocked by an openable channel cover 17 having a piece of arc-shaped packing 16.

Figure 20:
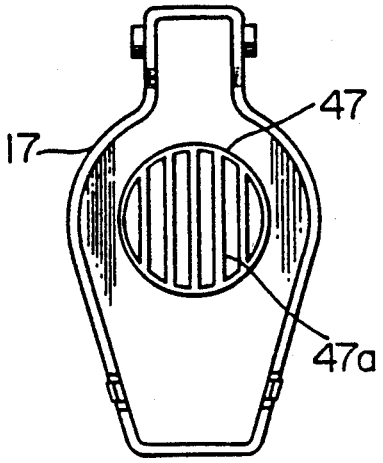
FIGS. 20–23 are diagrams illustrating a channel cover.
Figure 21:
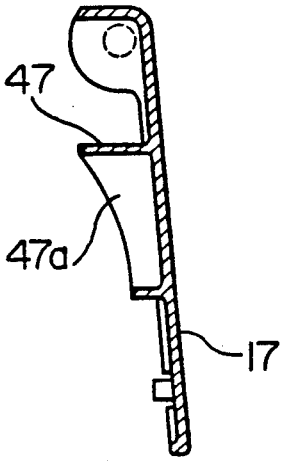
Figure 22:
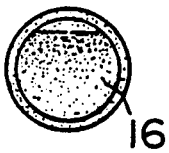
Figure 23:
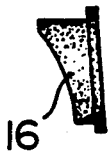

As shown in FIGS. 17, 20 and 21, the cover 17 is pivotally mounted on the main body case 7, and is provided with an insertion part 47 in which a plurality of ribs 47*a* are arranged so as to form a grid. In addition, the packing 16 constituted by an elastic material such as plastic or rubber, as shown in FIGS. 22 and 23, is placed over the insertion port 47.

Dust on the floor is collected into the dust filter 59 through the suction port 2, the rotary brush 4, the ducts 41, 42, and the T-shaped joint 4. While the dust passes through the T-shaped joint 4, it is possible to prevent the dust clogging by making the dust jump along the curved surface of the insertion part 47 towards the dust filter 59. If the T-shaped joint 4 does become clogged with dust, it is possible to remove the dust easily by opening the cover 17.

Figure 19:
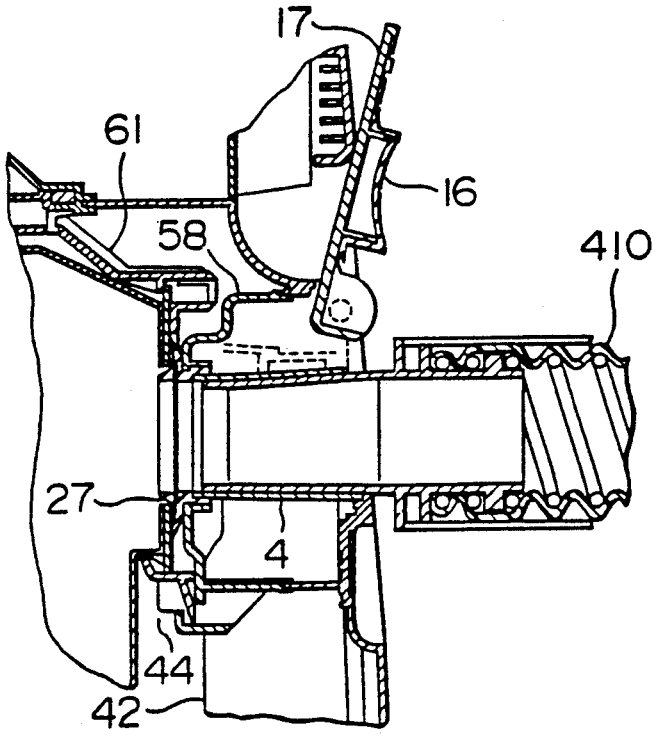
FIG. 19 is a diagram in which another suction hose is connected to the T-shaped joint.

In addition, a separate accessory hose 410, which is used for cleaning the corners of the floor and similar surfaces, can be inserted into one end of the T-shaped joint 4, as shown in FIG. 19.

Figure 24:
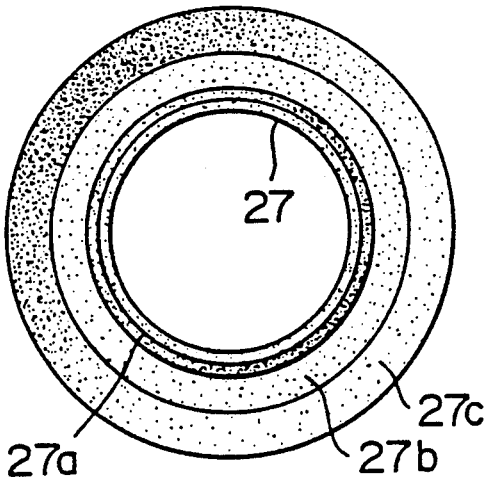
FIGS. 24 and 25 are front and side elevational views, respectively, of a seal packing at an inlet portion of a dust filter.
Figure 25:
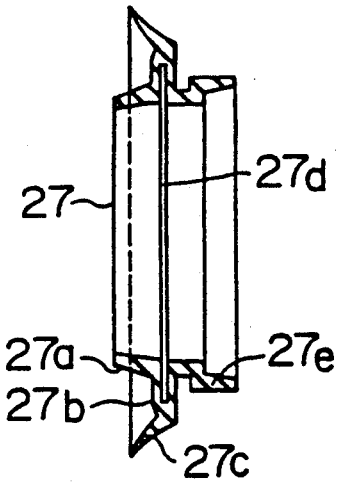

As shown in FIG. 17, the lefthand opening 9*a* of the joint 4 is connected to the dust filter 59. In addition, a filter installation member 58, which is located between the main body duct 42 and the dust filter 59, and provided with airtight packing 27 thereon, is screwed to the main body case 7. A pad 60 provided in the opening of the dust filter 59 abuts against the airtight packing 27. In other words, the dust filter 59 is installed by engaging the upper and lower edges of the pad 60 in a filter holder 61, and the filter holder 61 is retained by a reel cover 63 of the cleaner body and the filter installation member 58. As shown in FIGS. 24 and 25, the airtight packing 27, formed of a soft material, has a conical portion 27*a* an annular flat portion 27*b* and an annular lip portion 27*c*. Incidentally, in the illustrated embodiment, an annular slit 27*d* is provided as a measure to enhance the effect of the resiliency of the packing 27. In a case where the diameter of the opening of the dust filter 59 is equal to or greater than that of the conical portion 27*a* (to be more accurate, the root portion of the conical portion 27*a*) of the airtight packing 27, but is less than the outside diameter of the annular flat portion 27*b*, it is possible to provide a double sealing for the dust filter 29 by the annular flat portion 27*b* and the annular lip portion 27*c*. Even if the diameter of the opening of the dust filter 59 is greater than that of the annular flat portion 27*b* of the airtight packing 27, it is possible to provide a sealing by the annular lip portion 27*c* if the diameter of the opening of thee dust filter 59 is less than that of the annular lip portion 27*c*. As is apparent from the foregoing description, in accordance with the present invention, it is possible to employ with compatibility any of a plurality of kinds of dust filter consisting of large and small diameters.

The degree of airtightness between the bag compartment 44 and the outside of cleaner is achieved by providing the perimeter of the front cover 63 with a packing. When the electrically-operated blower 6 is operated, the bag compartment 44 is designed to have a negative pressure. A dust meter 65, which has the function of allowing a bypass flow to enter from the outside, is disposed in the front cover 63 to inform the operator when it is necessary to dispose of the dust collected inside the filter 59, and to prevent any temperature rise due to insufficient cooling of the electrically-operated blower 6 if the volume of air should drop.

Figure 26:
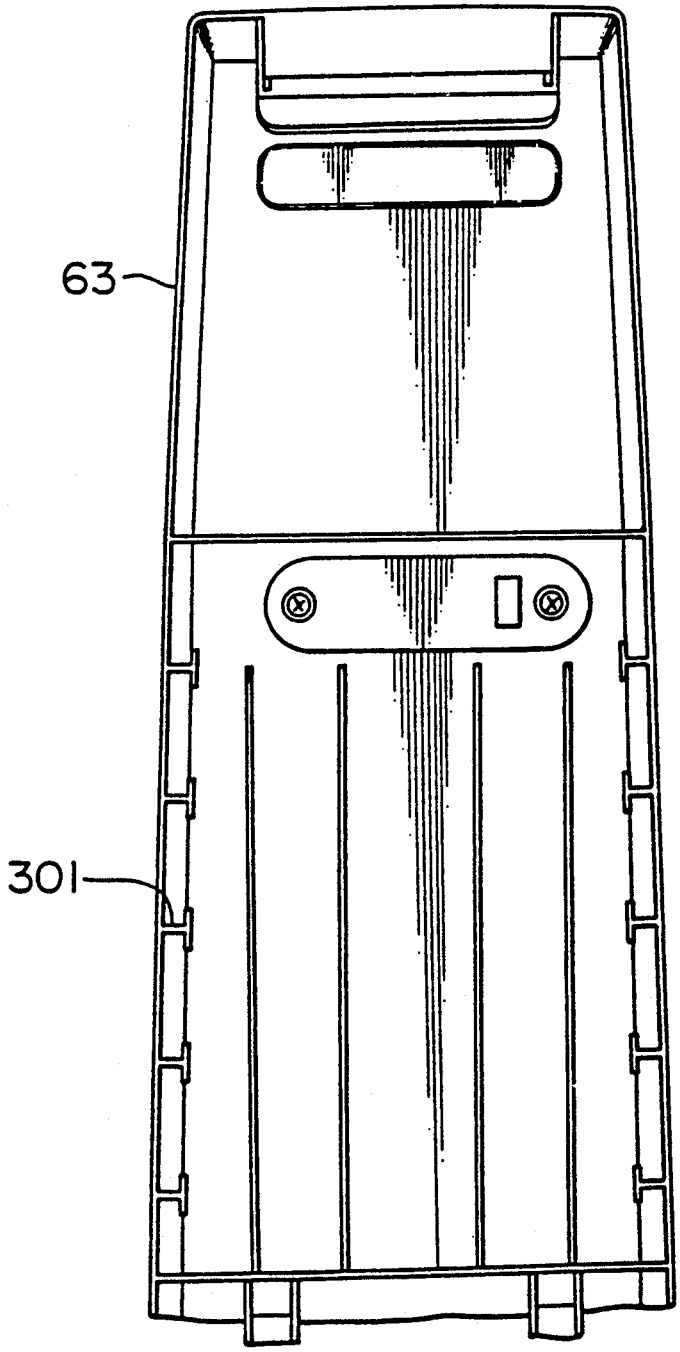
FIG. 26 is a front elevational view of a main body case cover.

As shown in FIG. 26, ribs 301, each having a substantially T-shaped cross section, are disposed on the inner side walls of the front cover 63. The tip of each T-shaped rib 301 has an inclined portion which fits into the side edges of the main body case 7 when the front cover 63 is mounted on the main body case 7, with the result that any deformation or warping in the main body case 7 or in the front cover 63 can be corrected, thereby maintaining the airtight surfaces in any case.

Since each rib 301 is formed substantially in a T-shape, a space is created between the filter and the rib, enabling an enhancement of the effect of preventing the close contact of the filter 59 to the front cover 63. In addition, the shaping of the ribs like the letter T has the advantages of preventing any damage to the filter 59, improving the strength of the ribs themselves, and preventing shrinkage and strain in the molding process thereof.

Figure 27:
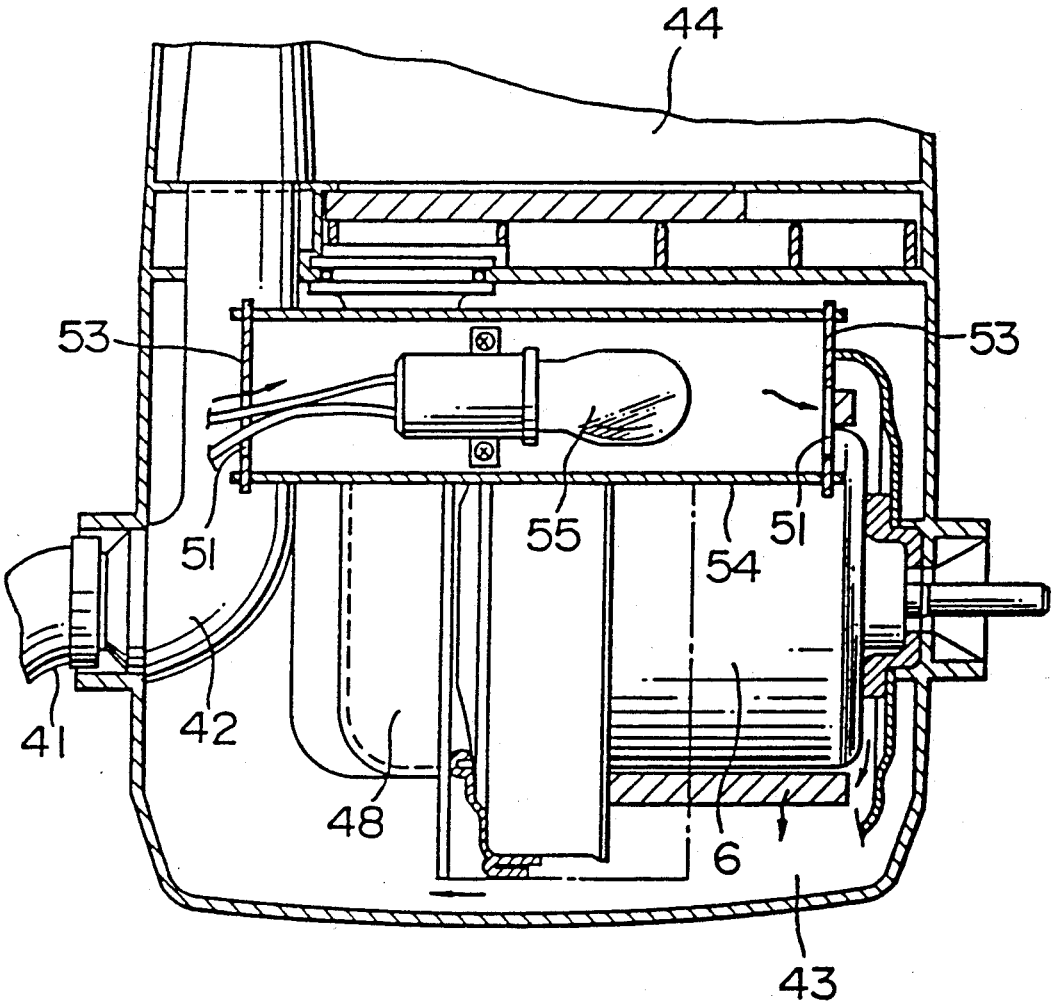
FIG. 27 is an explanatory diagram of an exhaust flow passing through a lamp chamber.

An illumination lamp 55 is provided in the blower chamber 43, and the light of the lamp is allowed to shine outside through a lamp window provided in the wall surface of the electrically-operated blower chamber 43. Part of the exhaust flow from the electrically-operated blower 6 is allowed to pass over the lamp 55 to reduce the surface temperature of the lamp 55. Namely, in FIG. 27, the electrically-operated blower 6 is disposed in the righthand portion of the electrically-operated blower chamber 43, and air is sucked from the bag compartment 44 via the suction duct 32. Part of the exhaust air from the blower is circulated in the blower chamber 43, and is then led into a lamp chamber enclosed by a reflecting plate 54, through a hole 51 provided in an end plate 53 of the lamp chamber, so as to cool the lamp 55.

Figure 2:
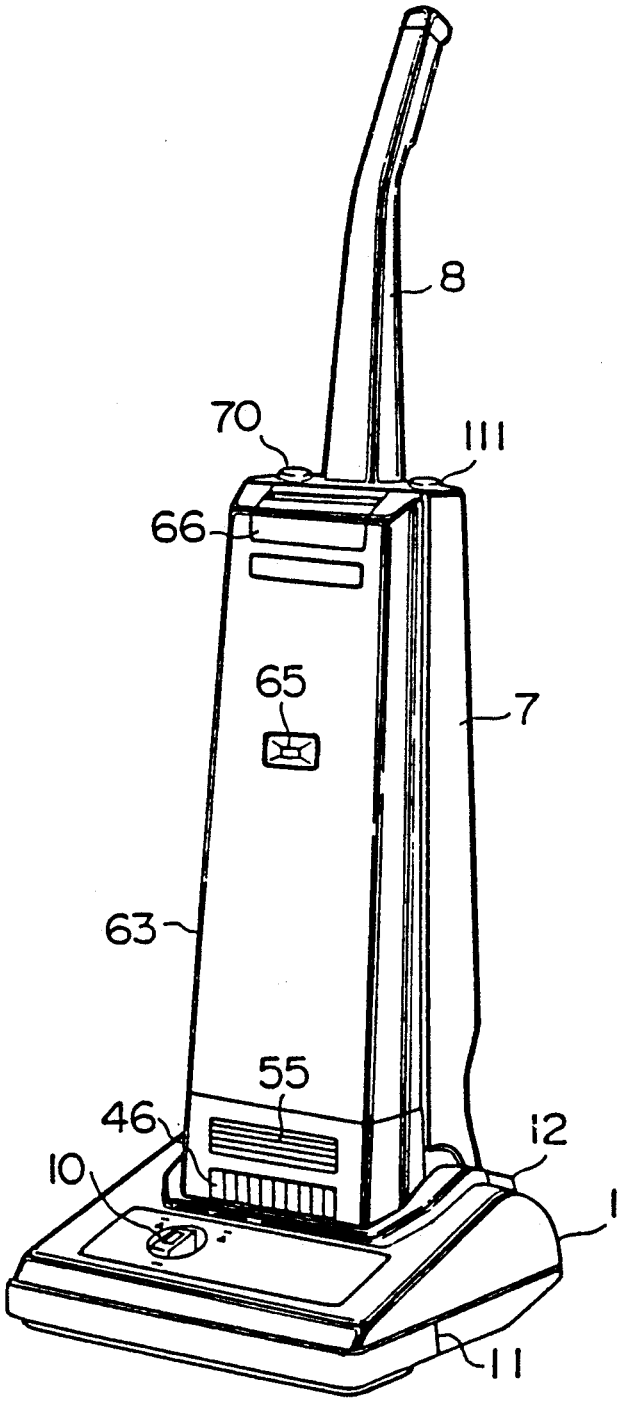
FIG. 2 is an external perspective view of the present embodiment.

As shown in FIGS. 1 and 2, a cord reel 68 for winding up the power cord 67, a power switch knob 111 with a variable resistor, and a cord reel button 70 are disposed in the cord reel chamber 45.

Figure 28:
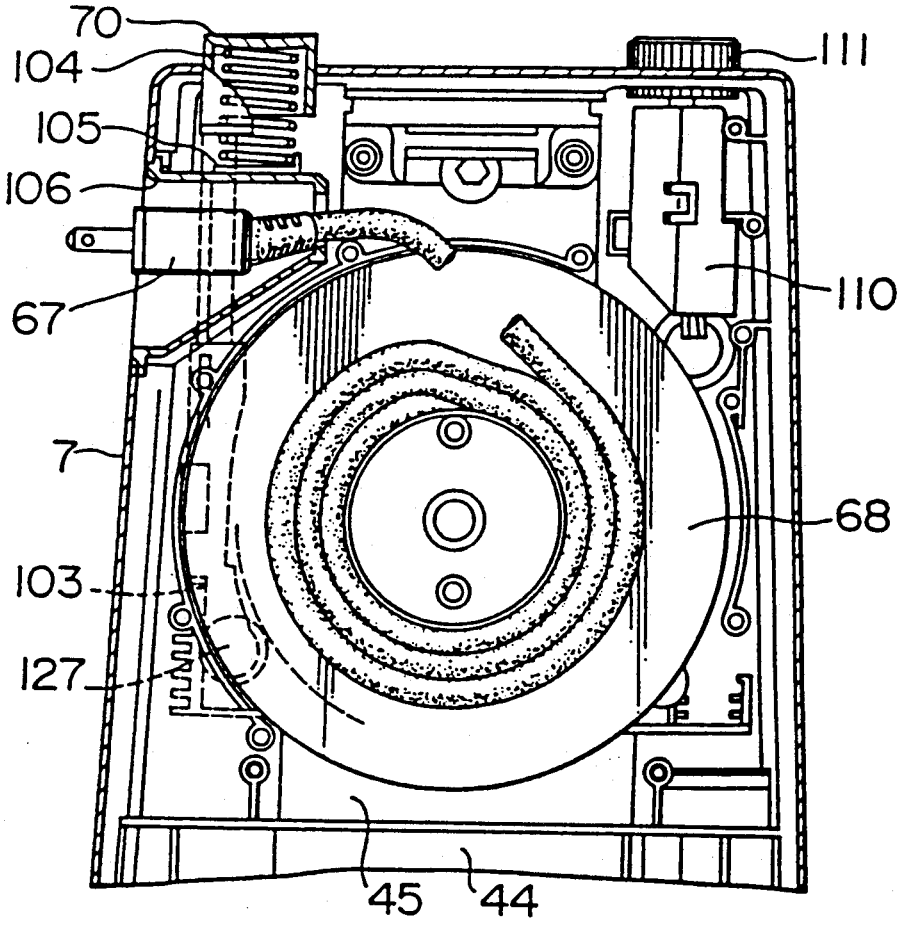
FIG. 28 is a view taken along the line XXVIII—XXVIII of FIG. 1.
Figure 29:
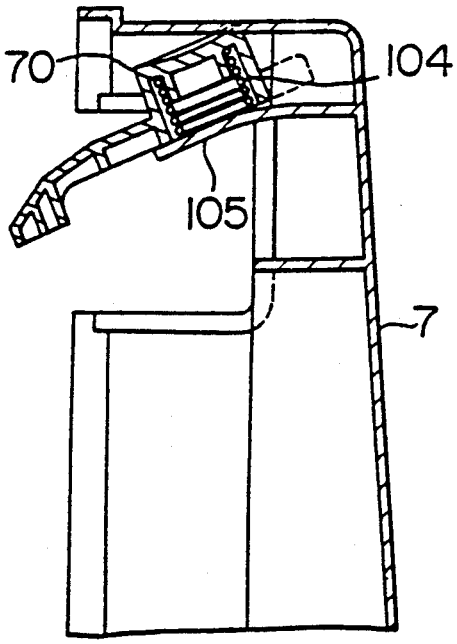
FIG. 29 is a diagram illustrating the fitting of a cord reel button.

As shown in FIGS. 28 to 31, the cord reel button 70 is urged in the upward direction of the main body by means of a button spring 104. During assembly, spring support rib 105 of reduced thickness provided in the main body case 7 is bent, as shown in FIG. 29. After the assembly, a card inlet 106 is inserted immediately below the spring support rib 105, as shown in FIG. 28, and is arranged to prevent any warping of the spring support rib 105. A power supply cord 72 from the cord reel 68 to the electrically-operated blower 6 is connected through the exhaust duct provided in the dust collecting section. As shown in FIG. 1, the cord reel chamber 45 is composed of the main body case 7 and a reel cover 74, and, as shown in FIG. 28 a roller lever 103 and a roller 127 for stopping the rotation of the cord reel 68 are mounted on the reel cover 74. The roller 127 is positioned in a wedge-shaped space between a peripheral wall of the cord reel 68 and a rib of the cover 74, and stops the reel 68 by virtue of wedging action resulting from the movement of the roller 127. The roller 127 is made of a rubber material. The roller 127 becomes worn as it is used over time, so that the operating position of the cord reel button 70 changes substantially. With this in mind, it is necessary to design the position and stroke of the cord reel button 70.

Figure 30:
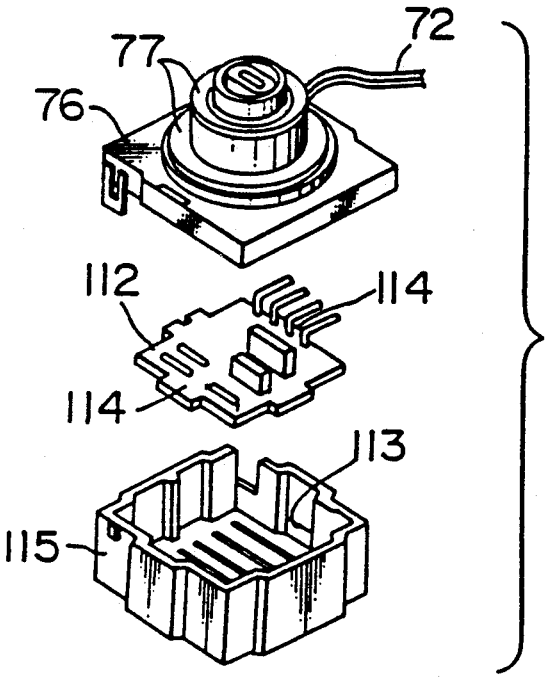
FIG. 30 is an exploded perspective view of a reel support base, a control circuit board, and a circuit board box.
Figure 31:
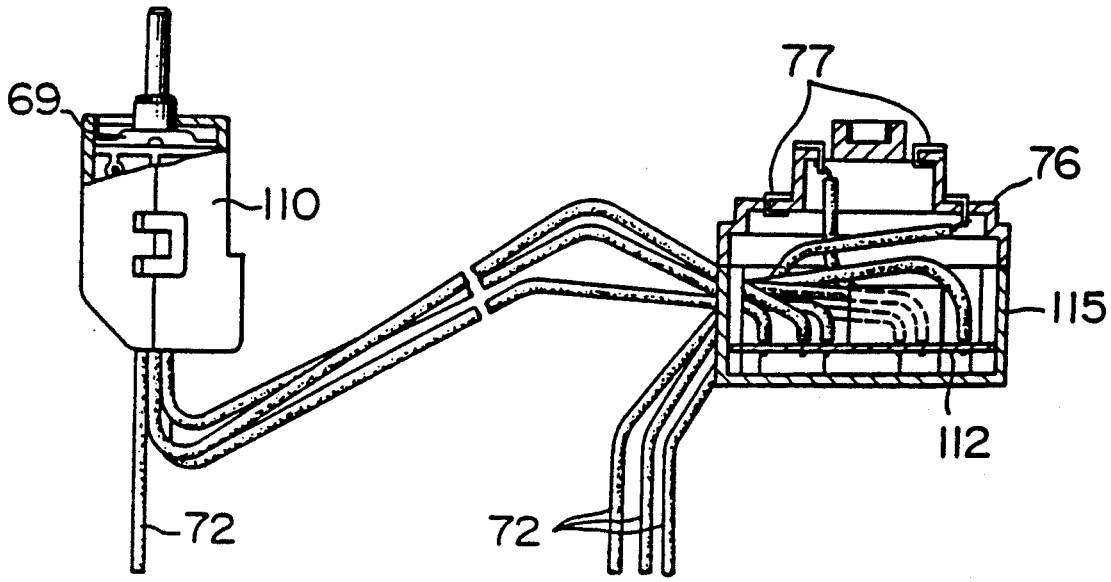
FIG. 31 is an assembly diagram, partly sectioned, of the parts shown in FIG. 30, after being assembled and connected to a switching portion.

In the event that the power cord 67 is disconnected and needs to be replaced, the arrangement is such that a contacting piece 75 shown in FIG. 1 can be separated from an annular contact 77 provided on a reel support base 76 disposed on the side of the main body case 7, as shown in FIGS. 30 and 31. This arrangement permits the power cord 67 to be replaced without the operator's fingers touching the power supply cord 72 connected to the contact 77.

As shown in FIGS. 30 and 31, a contact cover 15 is mounted on the reel support base 76 on which is provided a control circuit board 112 for controlling the power consumption of the cleaner. As for this control circuit board 112, retainers 114 thereof engage with engaging projections 113 of the contact cover 115 so as to be installed and retained. Since a control circuit is disposed inside a box formed by the reel support base 76 and the contact cover 115, this arrangement is favorable in terms of the protection of the circuit.

Figure 32:
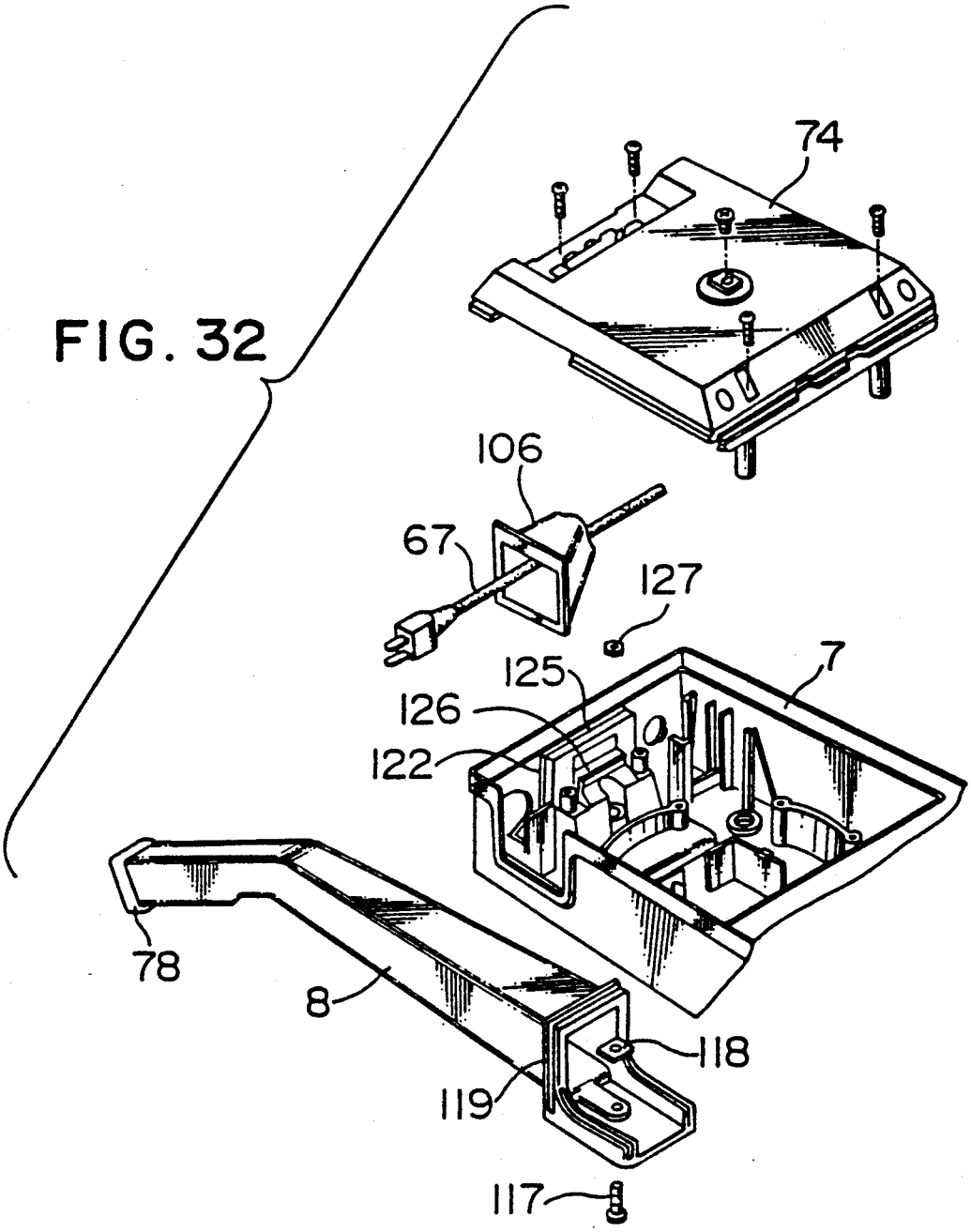
FIG. 32 is an exploded perspective view of a handle-mounting portion in accordance with the present embodiment.
Figure 33:
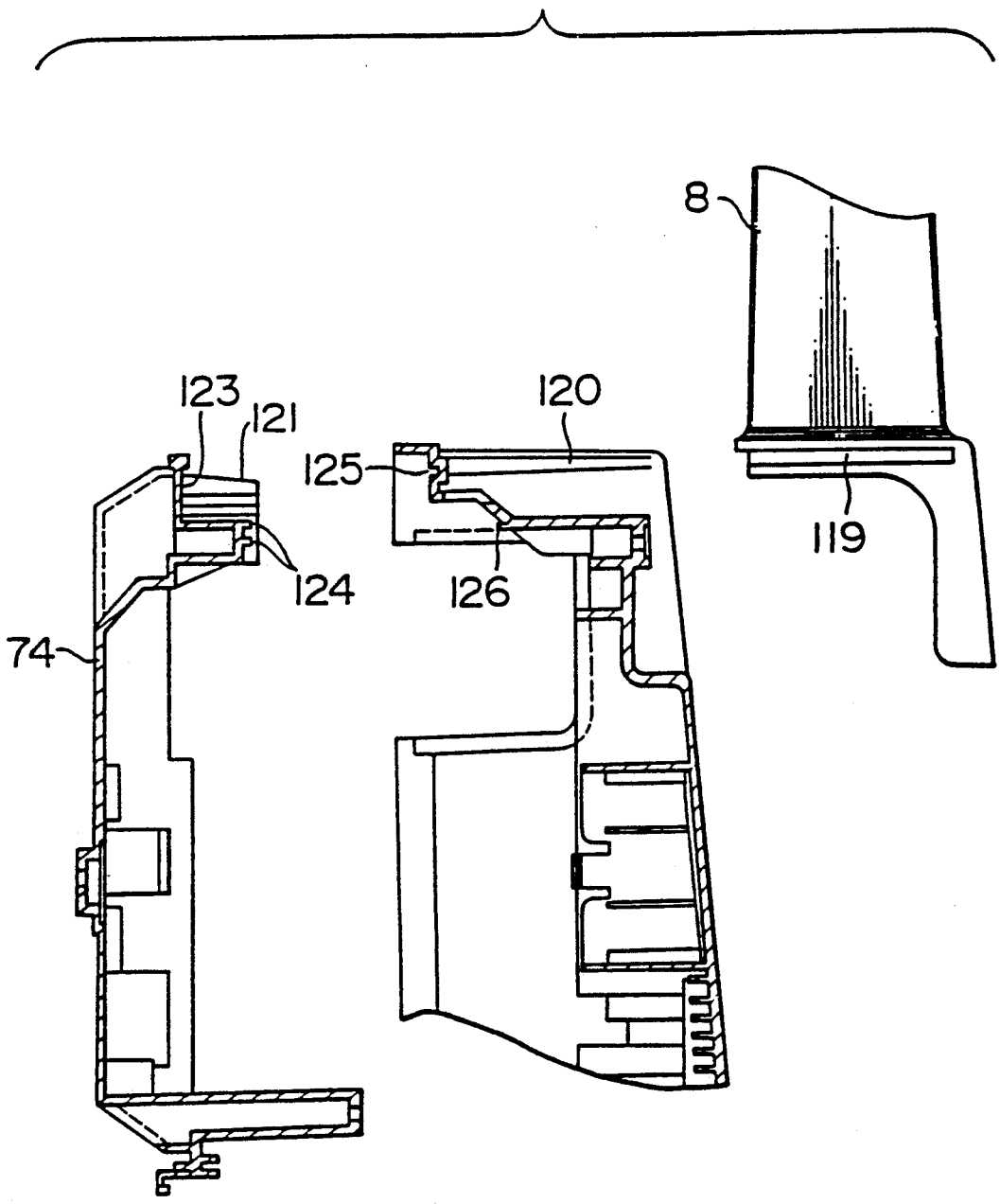
FIG. 33 is an exploded cross-sectional view of the handle-mounting portion.
Figure 34:
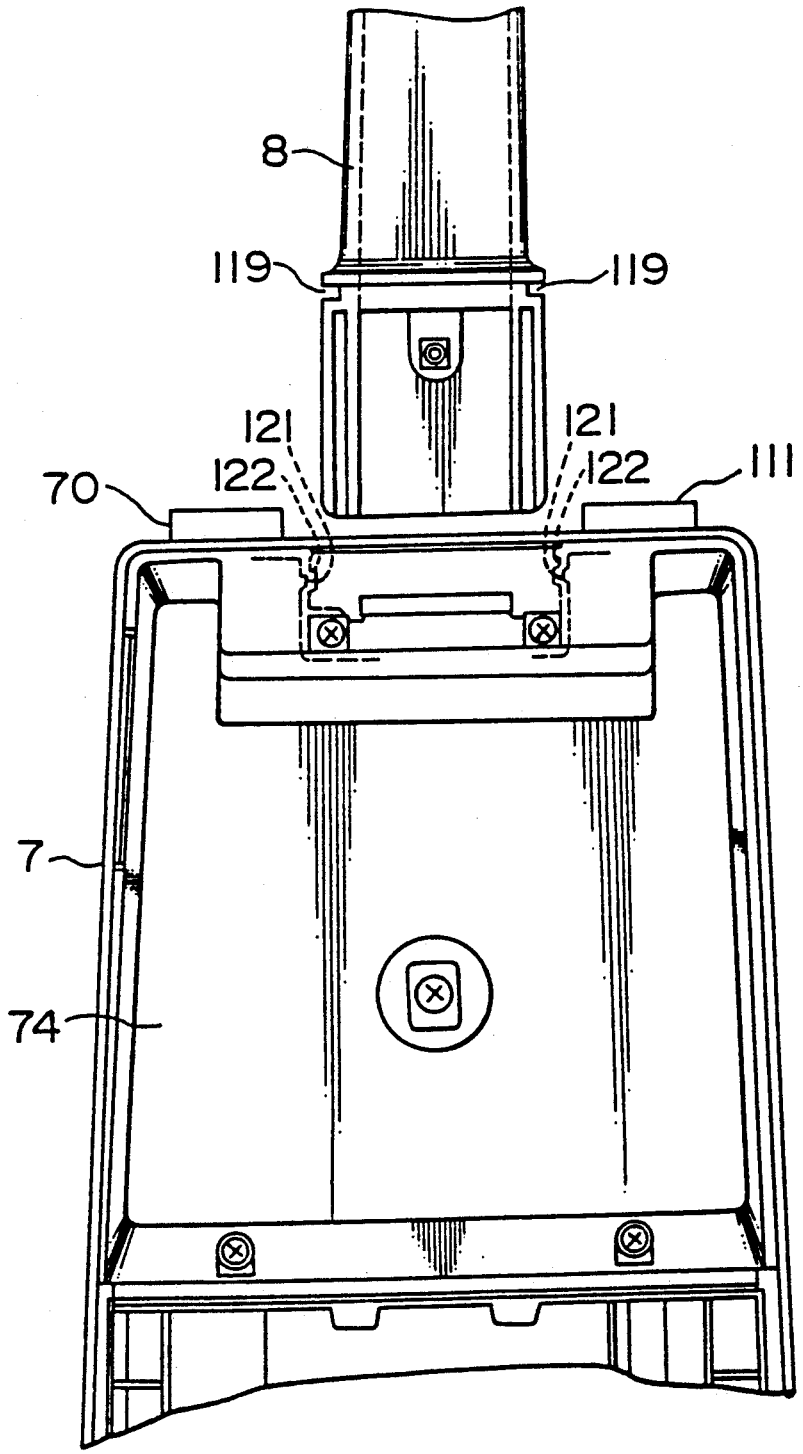
FIG. 34 is a view taken along the line XXXIV—XXXIV of FIG. 1, with the handle removed.

As shown in FIGS. 32 and 34, a main body-mounting portion of the handle 8 is provided with a set screw 117 for preventing the handle 8 from coming off as well as with a retainer 118 for retaining the same in the handle 8. A groove 119 extending perpendicularly of the longitudinal direction of the handle 8 is provided on both sides of the main body mounting portion of the handle 8. The main body case 7 is provided with a fixing nut 127 embedded therein, to which the set screw 117 is fixed, and a rib-like projection 120 to fit into the groove 119 of the handle. Since they are fitted together, the strength of mounting the handle 8 onto the main body case 7 is ensured. In order that the force conveyed from the handle 8 to the main body case 7 may be further imparted to the reel cover 74 with sufficient mounting strength and stiffness, a projection 121 extending in the same direction as the projection 120 in the main body case 7 is provided on the reel cover 74 covering the cord reel 68. The arrangement is such that a groove (main body) 122 for fitting into this projection 121 is provided in the main body case 7 and is fitted with the same. Incidentally, in the present embodiment, fitting ribs (reel cover) 123, 124 are provided on the reel cover 74, and fitting ribs (main body) 125, 126 for fitting with the same are provided on the main body case 7.

Hereinafter, description will be made of the use of an upright-type cleaner according to the present embodiment constructed as explained above.

At the time of using the vacuum cleaner, the power cord 67 is drawn out from the cord reel 68 and is connected to the power source, and the main body case 7 is then tilted on the suction port body 1 by depressing the pedal 12 located in the rear of the suction port body 1.

Then, the height of the rotary brush from the floor surface is adjusted to an appropriate height in accordance with the height of the yarn of a rug by operating a changeover knob 10.

Subsequently, if the power switch 69 is turned ON by means of a knob 111, the electrically-operated blower 6 is operated with the rotary brush 4 rotated via the belt 5, and with the dusts suctioned through the duct 41.

When operated, an air flow containing a lot of dust flows through the opening 3 in the bottom plate 2 of the suction port 1, passes through the suction duct 41 and the main body duct 42, and flows into the filter 59, where it is filtered and separated into a clean air flow and dust. Only the clean air flow passes through the suction port 47, the suction duct 48, and the electrically-operated blower 6. Part of this clean air is exhausted to the outside of the machine from the exhaust port 46, while the rest flows around the periphery of the illumination lamp to cool the same. Furthermore, part of this clean air is led to the card reel chamber 45 via the exhaust duct. The exhaust air is exhausted to the outside of the machine after cooling the power cord 67, the contacting piece 75 of the cord reel 68, the contact 77 of the reel support base 76, and the like.

We claim:

1. An upright-type electric vacuum cleaner, comprising:

a main body case having an electrically-operated blower chamber, a bag compartment, and a dust filter accommodated in said bag compartment;

a suction port body tiltably supporting said main body case; and an electrically driven rotary brush accommodated in said suction port body, said rotary brush having around an outer periphery thereof spirally arranged bristles and at least a pair of integrally-formed spiral projections, said rotary brush having at all cross sections thereof perpendicular to an axis of said rotary brush a symmetrical configuration with respect to a center of said cross sections, each of said at least a pair of spiral projections being divided into a plurality of spiral pieces in a longitudinal direction of the rotary brush, said projections being provided on the front and rear of the outer periphery of the rotary brush as seen in a plan view taken perpendicular to the center axis of the brush and said projections being symmetrically disposed about the center axis of the brush, the cross-sectional configuration of said projections being such that no undercut portion exists between each projection and an adjacent peripheral portion of said rotary brush so that said rotary brush can be produced by a pair of molds mating in a plane which includes the axis of said rotary brush.

2. A vacuum cleaner according to claim 1, wherein said bristles are embedded into both end regions of the rotary brush diagonally with directions radially outward and axially outward of the rotary brush, a pair of ribs which extend vertically while sandwiching said rotary brush are provided on each side wall of said front frame of said suction port body, so that, when said rotary brush rotates, said diagonally embedded bristles abut against the opposing surface of said ribs and said bristles are bent towards the axis of said rotary brush.

* * * * *